US005857891A

United States Patent [19]

Dahlgren

[11] Patent Number: 5,857,891

[45] Date of Patent: Jan. 12, 1999

[54] MOUNTING FOR PADDLE WHEEL OF A WATER ACTIVITY TOY

[75] Inventor: Lennart Dahlgren, Askim, Sweden

[73] Assignee: Aquaplay AB, Sweden

[21] Appl. No.: 899,583

[22] Filed: Jul. 24, 1997

[51] Int. Cl.[6] ..... A36H 23/00

[52] U.S. Cl. ..... 446/153; 446/246; 446/429; 446/163

[58] Field of Search ..... 446/163, 153, 446/155, 176, 201, 267, 236, 246, 429, 164; 416/244 R, 244 B, 142 A, 70 R, 142 B, 142 R

[56] References Cited

U.S. PATENT DOCUMENTS

| | | | |
|---|---|---|---|
| 930,613 | 8/1909 | Pressey | 446/153 |
| 1,533,493 | 4/1925 | Baty | 446/159 |
| 1,580,046 | 4/1926 | Jones . | |
| 1,624,282 | 4/1927 | Russell . | |
| 2,604,055 | 7/1952 | Snowden . | |
| 4,963,116 | 10/1990 | Huber | 446/153 |
| 5,637,025 | 6/1997 | Dahlgren | 446/153 |
| 5,656,943 | 8/1997 | Dahlgren | 446/153 |

FOREIGN PATENT DOCUMENTS

| | | | |
|---|---|---|---|
| 909382 | 5/1946 | France | 446/153 |
| 967657 | 11/1950 | France | 446/153 |
| 1587277 | 4/1981 | United Kingdom | 446/153 |

*Primary Examiner*—Robert A. Hafer
*Assistant Examiner*—Jeffrey D. Carlson
*Attorney, Agent, or Firm*—Ostrolenk, Faber, Gerb & Soffen, LLP

[57] ABSTRACT

A water activity toy has a channel for a stream of water which floats a vessel on the stream, and a paddle wheel that moves through the channel to generate the stream. The paddle wheel includes a plurality of blades on axle stubs which are removably mounted on mountings at opposite sides of the channel. A crank used to rotate the paddle wheel is connected with one axle stub which is liftable out of its mounting. Lifting the crank tilts the paddle wheel to provide clearance for a tall vessel floating by the paddle wheel mountings. The mountings have similar constructions and are oppositely facing. Each mounting includes a horizontal open ended bearing slot having a side slot with a constriction at the outboard end of the slot. Each axle stub includes parallel flattened surfaces which form a reduced dimension region that enables the axle stub to pass radially through the constriction, provided that radial protrusions on the flattened surfaces are out of alignment with the constriction. Otherwise this axle stub must be tilted and withdrawn through the inner open end of the bearing slot.

14 Claims, 6 Drawing Sheets

MOUNTING FOR PADDLE WHEEL OF A WATER ACTIVITY TOY

BACKGROUND OF THE INVENTION

The present invention is an improvement of the water activity toy disclosed in U.S. Patent application Ser. No. 08/571,489 filed 3 Dec. 1995 now U.S. Pat. No. 5,655,943 entitled Paddle Wheel For Moving Stream In a Water Activity Toy, and relates more particularly to an improved mounting that supports the paddle wheel to rotate and enables its easy installation and temporary repositioning.

application Ser. No. 08/571,489 describes an activity toy which includes a paddle wheel which generates a water stream that moves along a water pathway, and a floating vessel is moved along the pathway by the water stream. The pathway for the stream is in a water container that is shaped to define a channel for the water stream. Typically, the channel is an endless loop along a circular, oval or otherwise interestingly shaped path.

The paddle wheel includes several axle supported blades which are rotated into and out of the channel to generate the water stream. The axle is rotationally supported in mountings on opposite sides of the channel. A manually operable crank for rotating the paddle wheel is connected with the axle. Sometimes the paddle wheel blades, and perhaps the entire paddle wheel, extend far enough down into the channel to serve as an obstacle to movement of a floating vessel past the paddle wheel. To avoid interference with the vessel moving along the channel past the paddle wheel, the wheel and blades are raised out of the channel while the vessel floats past.

application Ser. No. 08/571,489, the paddle wheel is supported by mountings at both sides of the channel, and is swingably supported at one side of the channel so that the paddle wheel can be tilted up out of the channel e.g. to permit a floating vessel to pass. To reduce the extent to which the paddle wheel must be tilted and to minimize interference with the vessel, the blades are spaced around the paddle wheel in a non-uniform array, leaving a large angular space around the paddle wheel which can be positioned over the channel when the vessel moves past, and reducing the bulk of the paddle wheel which might interfere with passage of the vessel.

SUMMARY OF THE INVENTION

The paddle wheel comprises at least one and preferably a plurality of paddle blades or vanes. While the paddle wheel may include as few as one blade, preferably the wheel includes two or three blades, but usually includes fewer blades than what might be considered sufficient to define a "wheel". All of the blades are supported on and project out from a single rotation axle having axle stub portions located at each side of the channel. A crank attached to one of the axle portions is rotated to rotate the wheel.

The number and placement of the blades around the paddle wheel are such that for at least one orientation of the paddle wheel, the outer or free edges of each of the blades are at least as high as or perhaps even higher than the roots or bottom edges of all of the blades at the axle, so that the blades will not interfere with the passage of a vessel along the channel. For example, viewed from the side of the channel, the blades may incline up from the roots of the blades, so that the roots of the blade are at the lowest height. In any event, the blades can be oriented so that the free edges of the blades are not lower toward the water than their base edges.

Further, the blades are held lowest over the channel at a selected rotation orientation of the wheel. Those blades need not be flat or planar across the channel, but are preferably curved, i.e. around an axis extending from the root or base edge to the free edge of the blade, so that with the paddle wheel at an orientation wherein the lowermost blades generally extend along the direction of the channel, each of the lowest height blades is higher above the water at its center across the channel than at the axle portions at the sides of the channel, with the curve being upward above the channel, creating a path beneath the center of the blade and between the base edge and the free edge for a vessel to pass the blade.

The axle stub portions are removably held for rotation in mountings at opposite sides of the channel. One of the mountings includes a bearing support and swing connection for one axle stub portion. The stub portion can rotate in the bearing support. It can also swing around with reference to that bearing support as a swing axis. This swing connection permits the entire paddle wheel to be pivoted up above the channel around that bearing support.

The other axle stub portion is supported in a bearing support passage that extends through the other mounting. The other axle stub portion can rotate in the bearing support passage and may be lifted upwardly, or more generally, radially out of that passage and lowered into that passage. The crank handle for rotating the paddle wheel is preferably connected at the other axle stub portion so that a user, anticipated to be a young child, can simply lift the paddle wheel above the channel by raising the crank. However, the child can do this only when the crank handle and the paddle wheel are at a predetermined rotation position. But, when the wheel is otherwise oriented, there may be interference between the wheel blades and a sidewall defining the channel. The mounting for the other axle stub portion cooperates with the shape of that portion to prevent raising or lowering of the axle stub portion when it is in the incorrect rotation orientation. Further, to lift the axle the child must exert sufficient force to slightly separate boundary walls that define a narrow radial side entrance/exit slot to the bearing support passage.

Accordingly, the primary object of the present invention is to provide an improved mounting that rotatably supports a paddle wheel which generates and moves a stream of water through a channel of a water activity toy.

Another object is to provide mountings of that type which removably hold the paddle wheel.

Still another object is to provide mountings of that type which simplify assembly of the water activity toy.

A further object is to provide mountings of that type which permit the paddle wheel to be moved easily out of a position obstructing passage of a vessel through the channel.

A still further object is to provide mountings of that type which reliably retain the paddle wheel against accidental separation from the mountings while the wheel is being turned.

Other objects and features of the present invention will become apparent from the following description of a preferred embodiment considered in conjunction with the accompanying drawings.

BRIEF DESCRIPTION OF THE DRAWINGS

In FIG. 2 the paddle wheel is tilted up and is disposed to operate while in an orientation opposite to that shown in FIG. 1;

DETAILED DESCRIPTION OF THE DRAWINGS

Figure 1:
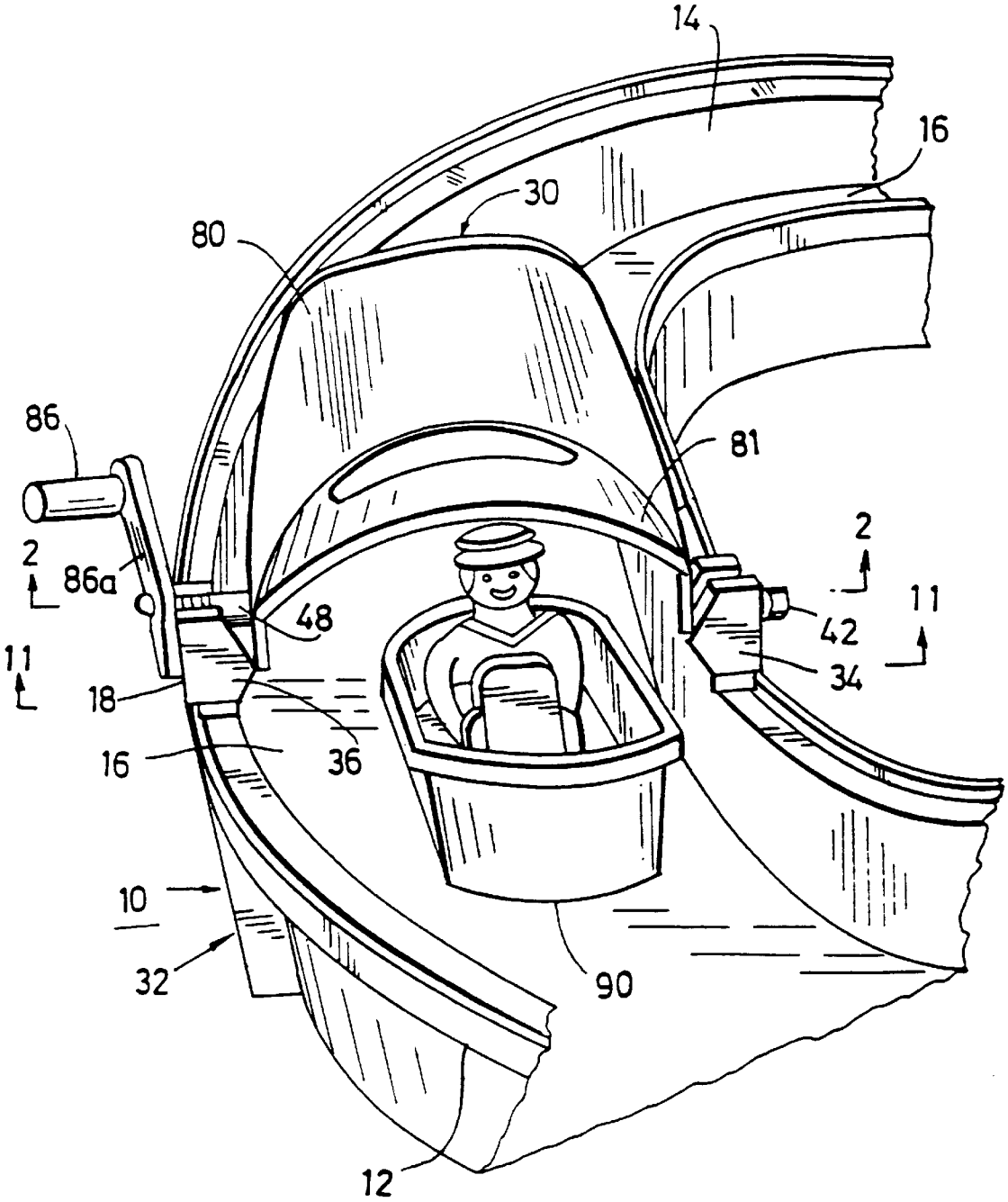
FIG. 1 is a perspective showing a portion of a water toy with paddle wheel axle stubs operatively supported for rotation in mountings on opposite sides of a water channel.

Referring to FIG. 1, water activity toy 10 comprises closed circuit tank 12 including narrow endless loop channel 14 which is partially filled with a water stream 16 when toy 10 is to be used. The path of channel 14 is not significant. It can be circular, oval, rectangular or any other shape. Only a part of tank 12 and channel 14 are shown here. Significant here is that the channel 14 includes a section 18 at which blades or vanes 80–82 of water impeller paddle wheel 30 are disposed for moving water to provide a moving stream 16. A toy boat 90 or other floating vessel rides on the stream as the water is pushed through channel 14 by the wheel 30.

Resilient plastic U-shaped support bracket 32 extends up the sides of the channel and is provided with identically constructed, oppositely facing mountings 34 and 36 that are disposed at the free upper ends of the respective arms 32*a*, 32*b* of bracket 32. Arms 32*a*, 32*b* lie against the outsides of respective opposite sidewalls 18*a*, 18*b* of channel section 18. Mountings 34 and 36 are essentially mirror images of each other. As shall hereinafter be seen, this enables paddle wheel 30 to be installed with crank 86 thereof on either side of channel 14. (Compare FIGS. 1 and 11).

Each mounting 34 and 36 includes a circular passage extending through the mounting in the axial direction with a round bearing surface 67 on which a respective axle stub rotates. The top edge of each passage is open, for enabling the axle stub portion 48 described below to be installed and removed in a radial direction from above. Axially outboard of each round passage at each side of the mounting defining the radial opening into the passage, there is a protrusion 65 that partially blocks the opening into the passage radially, i.e. from above, so that the stub portion 42, described below, cannot be removed radially and the stub portion 48 can be installed or removed only at one orientation.

Figure 9:
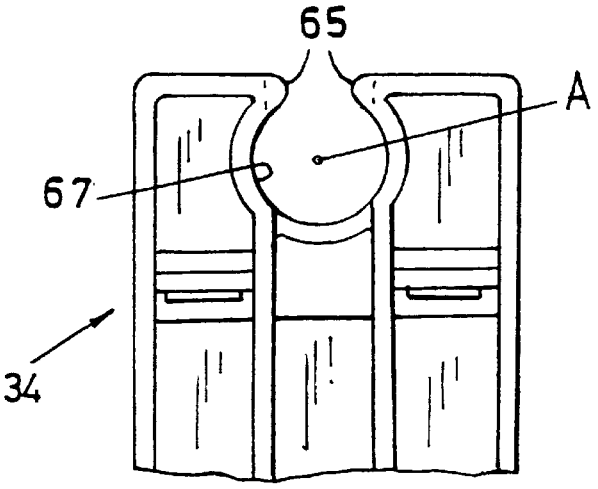

FIGS. 3 through 6 show that paddle wheel 30 includes a first free end axle stub portion 42 at one side thereof. In the operating orientation of FIG. 11, portion 42 is received in mounting 34 which enables the paddle wheel 30, including the axle stub portion 42, to rotate about axis A (FIGS. 9 & 11) as a center. In this operating position, opposite, second axle stub portion 48 at the crank end of wheel 30 is supported by mounting 36.

Figure 11:
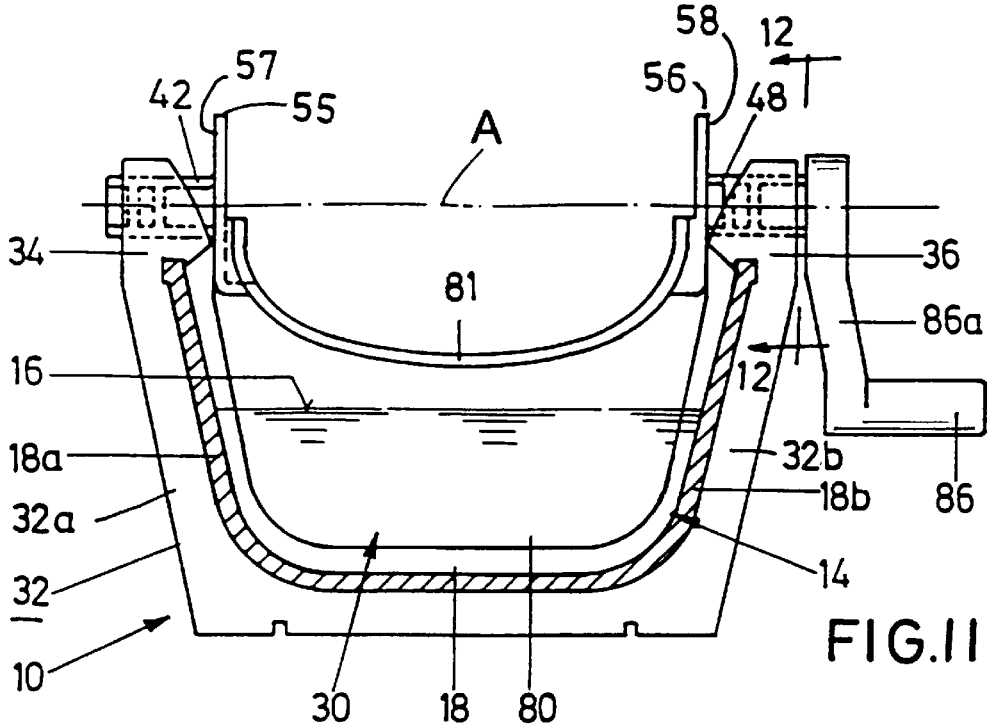
FIG. 11 is a transverse section of the water channel taken through line 11—11 of FIG. 1 with the wheel crank oriented opposite to that shown in FIG. 1.

In cross-section (FIGS. 6 and 12), each axle stub portion 42, 48 is a round ended rectangle with outwardly curved opposite partially circular end sections 51, 52 which are connected by parallel straight sections 53, 54. Disposed at the inboard ends of respective axle stubs 42, 48 are respective plate-like formations 55, 56 having respective locating planes 57, 58 that are generally perpendicular to the rotational axis of wheel 30 defined by axially aligned axle stubs 42, 48. As seen in FIG. 11, the spacing between the most inboard points of mountings 34 and 36 is essentially equal to the spacing between parallel locating planes 57, 58 to maintain wheel 30 in a fixed position along axis A.

Each flat section 53, 54 of second, crank axle stub 48 is provided with two axially separated, radially protruding, full circular ribs 61, 62 whose outer surfaces are essentially equal in radius to that of circular sections 51, 52 and appear as continuations thereof. Similarly, each flat section 53, 54 of first free end axle stub 42 is provided with two axially separated, radially protruding, circular ribs 63, 64 whose outer surfaces are essentially equal in radius to that of circular sections 51, 52 and appear as continuations thereof. For reasons that are later described, the axial spacings of ribs 61, 62 from plane 58 are not the same as the axial spacings of ribs 63, 64 from plane 57. When wheel 30 is in the operating position of FIG. 4, both ribs 61, 62 are inboard of protrusions 65 of mounting 36 so that all protrusions 61, 62 ride on round bearing surface 67 of mounting 36 and so that the axle stub 48 can be lifted in the radial direction out of and lowered into the passage through mounting 36 without interference from adjacent protrusion 65.

Further, at the other side of the paddle wheel, when the axle stub 42 is installed in the mounting 34, both outboard ribs 64 are axially aligned with and confined beneath protrusions 65 of mounting 34 so that there will be mechanical interference against separation of free end axle stub 42 from mounting 34 by moving stub 42 radially outward. Instead, the stub 42 is removed by first tilting wheel 30 (as in FIG. 2) upward to remove axle stub 48 from mounting 36 and then sliding axle stub 42 axially inward along bearing surface 67 from beneath protrusions 65 and out of mounting 34.

Figure 2:
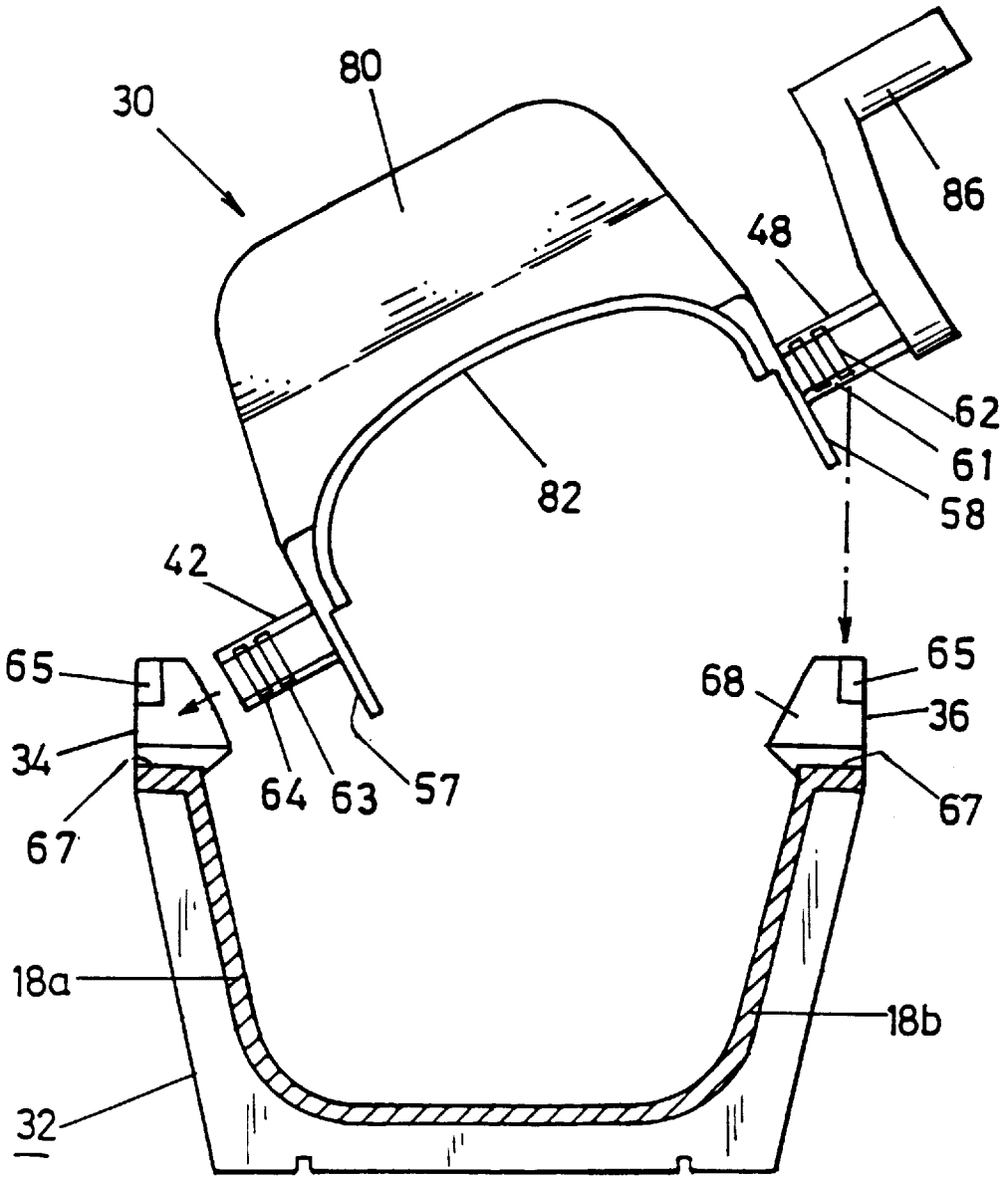
FIG. 2 is a cross-section taken through line 2—2 of FIG. 1 looking in the direction of arrows 2—2.
Figure 5:
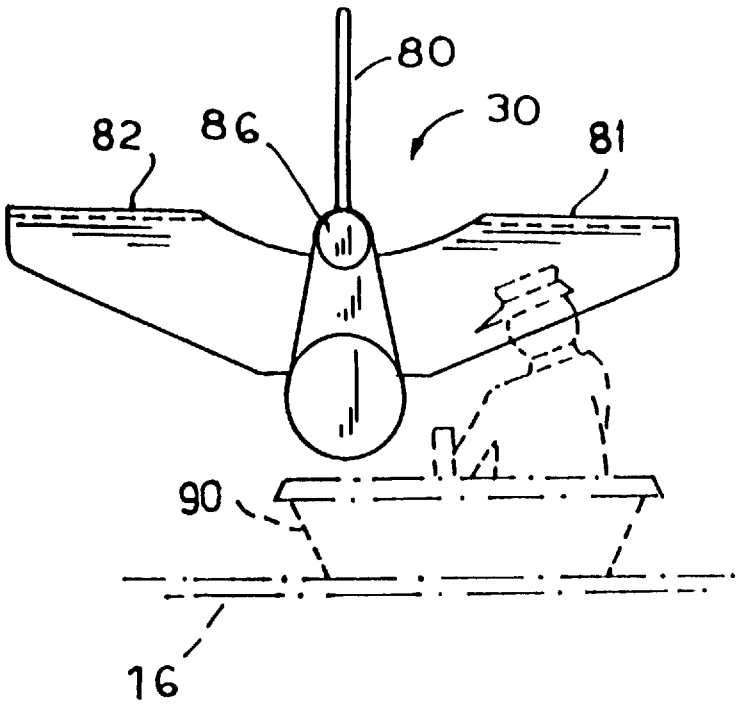
FIG. 5 is a side view of the paddle wheel looking in the direction of arrows 5—5 of FIG. 3.
Figure 3:
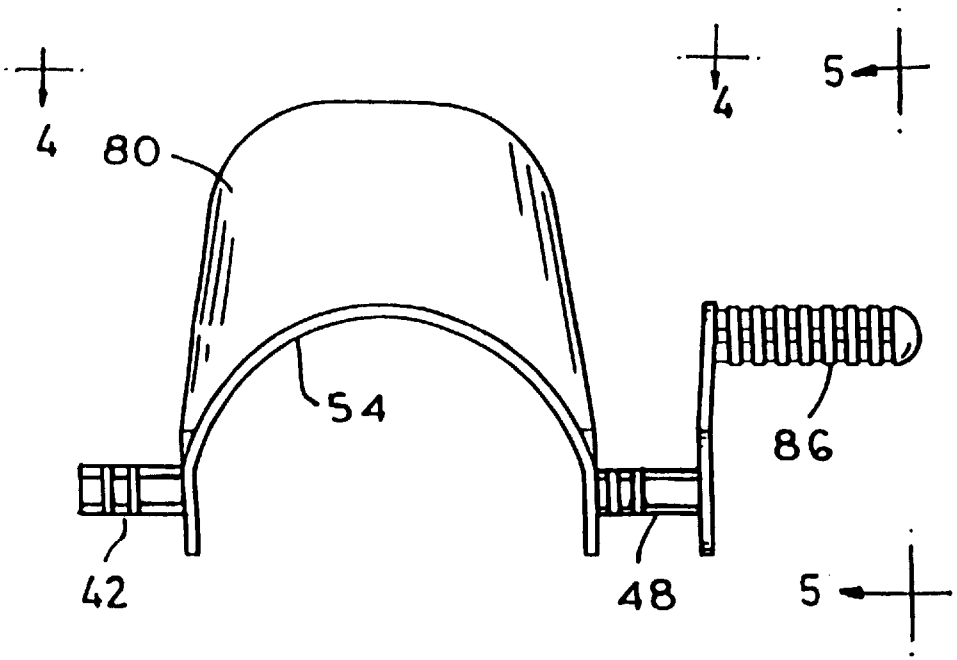
FIG. 3 is an end view of the paddle wheel.
Figure 4:
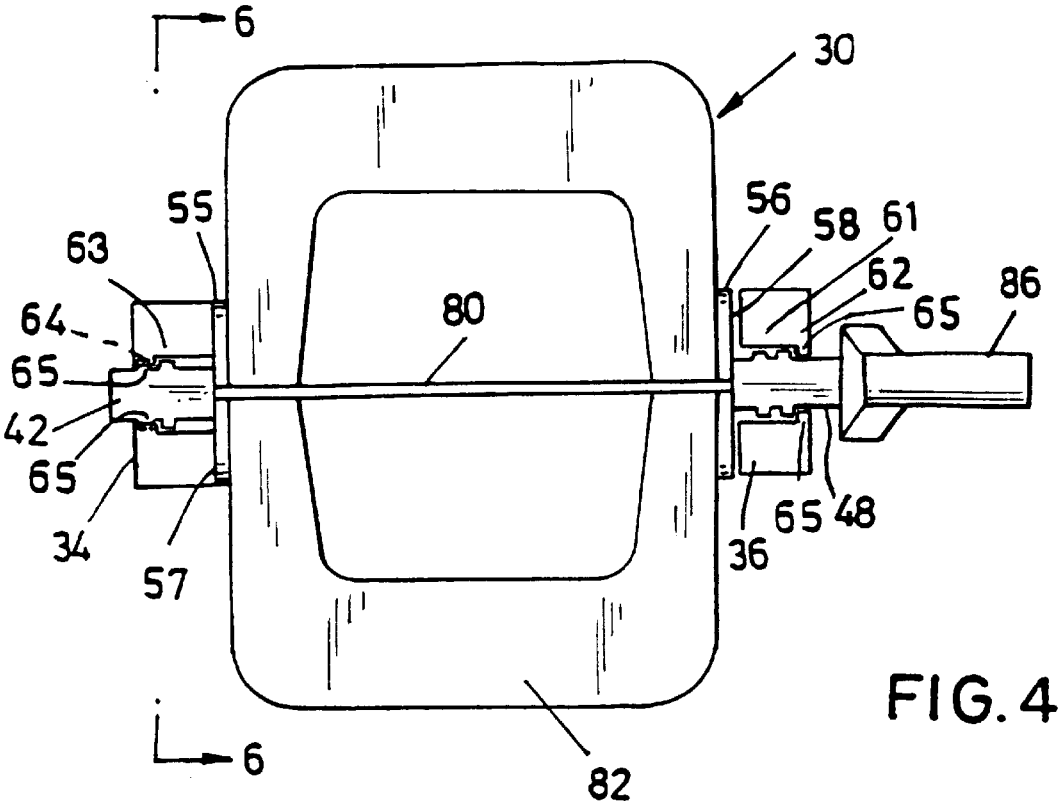
FIG. 4 is a plan view of the paddle wheel supported in its mountings and looking in the direction of arrows 4—4 of FIG. 3.
Figure 6:
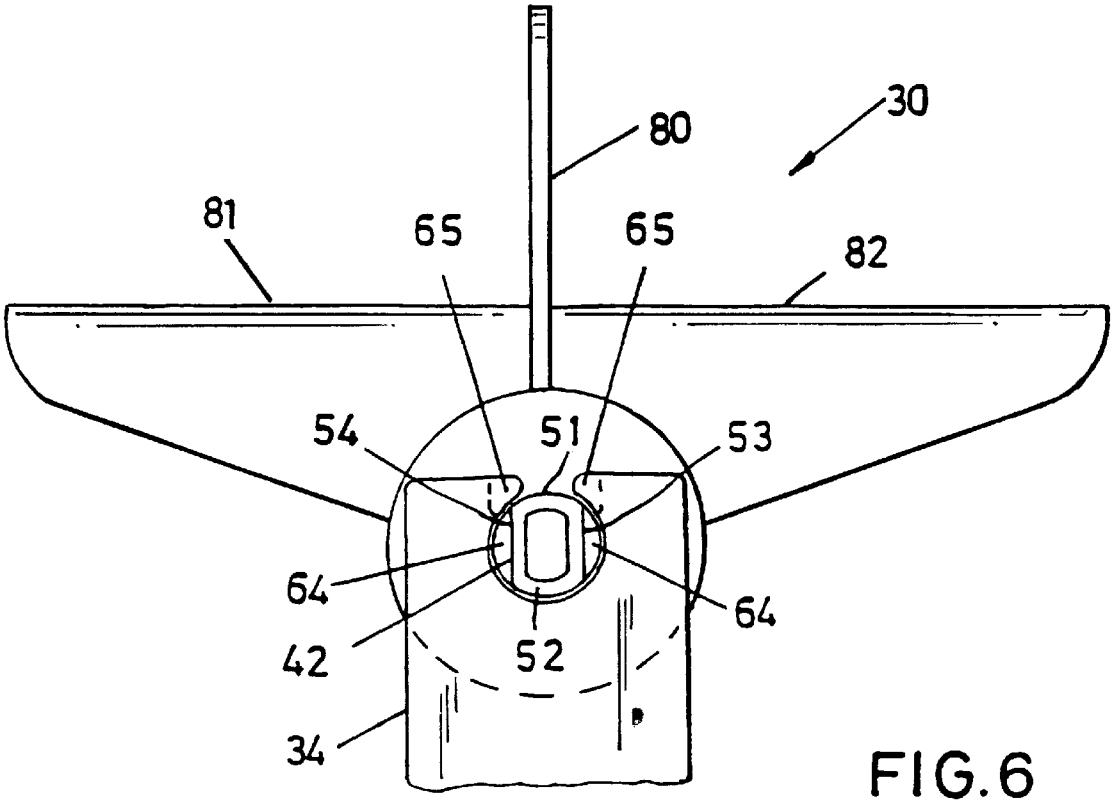
FIG. 6 is a side view of the paddle wheel looking in the direction of arrows 6—6 of FIG. 4.
Figure 7:
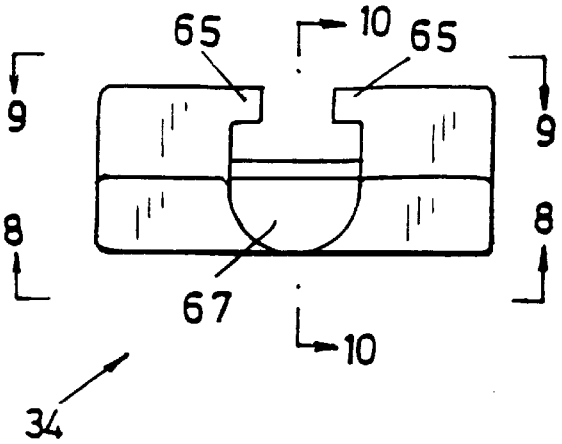
FIG. 7 is a plan view of one of the axle stub mountings.
Figure 8:
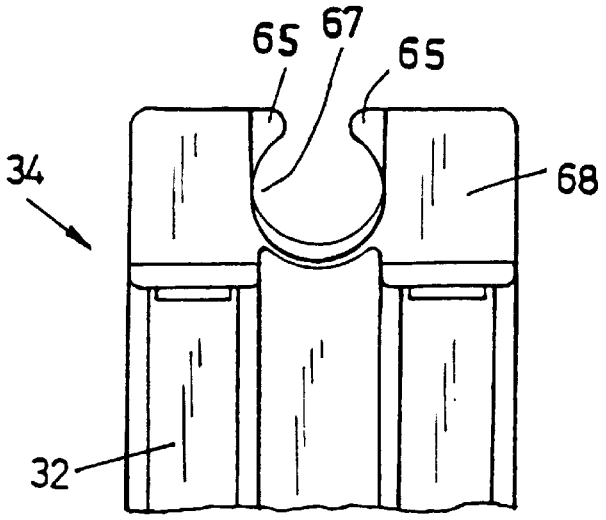
FIGS. 8, 9 and 10 are elevations of the mounting in FIG. 7 looking in the directions of the respective arrows 8—8, 9—9 and 10—10.
Figure 10:
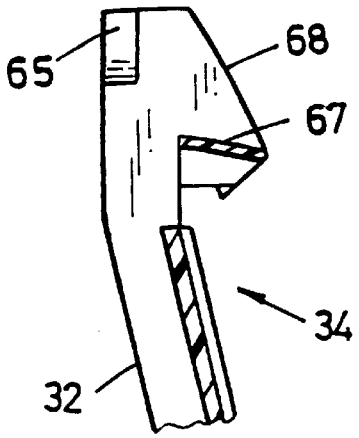
Figure 12:
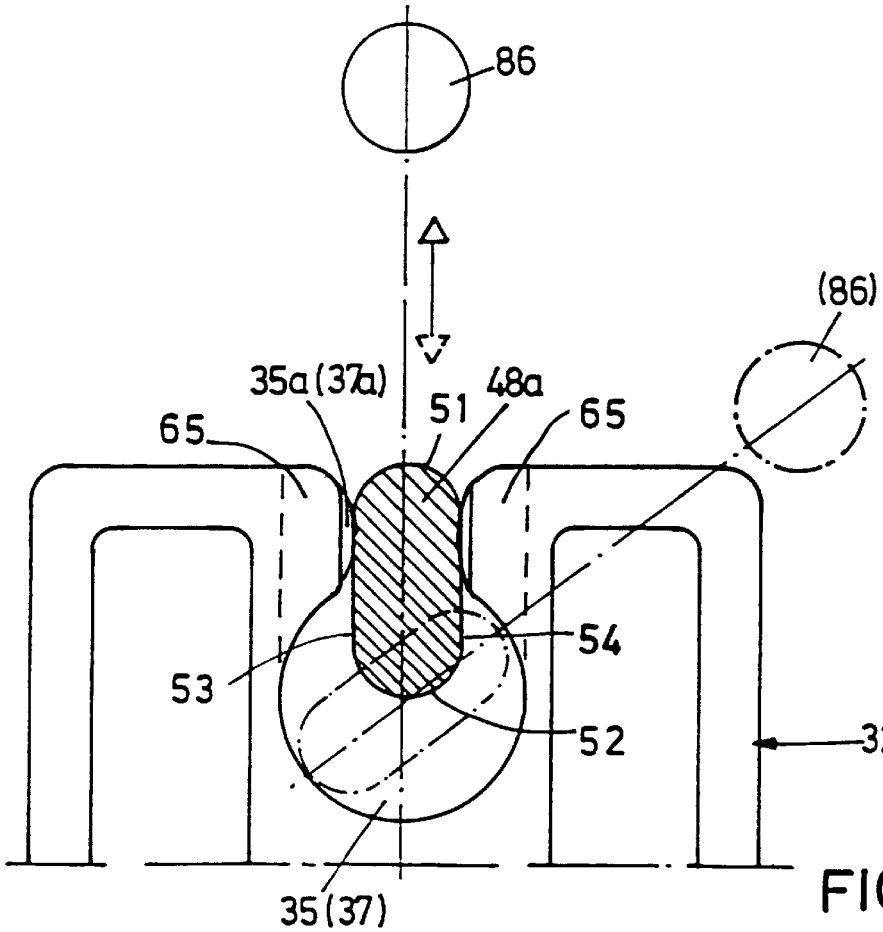
FIG. 12 is a fragmentary side elevation looking in the direction of arrows 12—12 in FIG. 11.

To install paddle wheel 30, start in its tilted position of FIG. 2, starting with free end axle stub 42 supported by mounting 34 and crank side axle stub 48 above mounting 35. Crank 86 is moved downward while sliding surface 58 against sloping surface 68 of mounting 36. Engagement of surfaces 58 and 68 causes clockwise pivoting of paddle wheel 30 (FIG. 2) about axle stub 47 on mounting 34 as a center. At the same time axle stub 42 moves to the left through the open ended axially extending bearing passage of mounting 34. This operation is performed while crank 86 is oriented as in the solid line position of FIG. 12 wherein bent arm 86*a* of crank 86 extends radially upward from axle stub portion 48. At this time the narrow transverse dimension of axle stub flattened portion 51 is horizontal (FIG. 12). This dimension is only slightly greater than the constriction defined by the relatively close spacing between protrusions 65, 65 so that as axle stub 48 is moved downward between protrusions 65, the protrusions are forced apart and then snap back to a normal blocking position which will retain axle stub 48 against accidental separation from mounting 36 but will permit a user to raise the properly oriented stub 48 out of the mounting 36.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A water activity toy including:

a channel with opposed sides and through which a stream of water may move;

a rotatable paddle wheel including at least one blade extending across said channel, and with said paddle wheel rotating about an operational axis, said at least one blade dipping into said channel to generate the stream of water through said channel;

said paddle wheel also including axially spaced coaxial first and second axle stubs that extend in opposite directions from said axis;

first and second mountings on said opposite sides of said channel to support said paddle wheel positioned with said first and second axle stubs in rotational operating position on said axis;

each said mounting including an axially extending bearing passage, said axle stubs being disposed in said bearing passages when said axle stubs are in said rotational operating position;

each of said mountings including a side slot into the respective said bearing passage, said side slot having an open section and a constricted section outboard of said open section, said bearing passage having a bearing surface to rotationally support an axle stub, said first axle stub having a cross-section with circular sections connected by a narrowed section, said circular sections and said bearing surface being generally of equal radii;

said narrowed section of said first axle stub having a radially projecting rib that is positioned to interfere with said constricted section of said first mounting and thereby prevent said first axle stub from being inserted radially through said side slot into rotational operating position in said bearing passage of said first mounting.

2. A water activity toy as defined by claim 1 in which the paddle wheel also includes oppositely facing first and second planar surfaces that are generally perpendicular to said respective first and second axle stubs and are disposed at respective inboard ends of said first and second axle stubs, said first and second surfaces being adjacent and inboard of said first and second mountings, respectively, whereby said mountings block axial movement of said paddle wheel.

3. A water activity toy as defined by claim 1 in which the first and second mountings are generally of the same construction and are oppositely facing.

4. A water activity toy as defined by claim 1 in which the second mounting includes an axially inwardly and downwardly sloping surface that faces said first mounting;

said paddle wheel including a formation that is moved downward along said sloping surface during installation of said paddle wheel on said mountings, such that cooperation between said formation and said sloping surface forces said first axle stub away from said sloping surface while moving said first axle stub axially through said bearing passage of said first mounting toward its outboard end.

5. A water activity toy as defined in claim 4 in which said mountings are shaped such that during installation of said paddle on said mountings, said axle stubs are sloped with respect to said operational axis while said first axle stub moves axially along said bearing passage toward its outboard end with sloping between said axle stubs and said operational axis decreasing as said first axle stub portion approaches the outboard end of said bearing passage of said first mounting.

6. A water activity toy as defined in claim 4 in which said radially projecting rib is axially aligned with said constricted section when said first and second axle stubs are positioned on said operational axis, whereby at this time cooperation, between said radially projecting rib and said projecting portions of said first mounting that define said constricted section prevents said first axle stub from being withdrawn radially from the bearing opening of said first mounting.

7. A water activity toy as defined in claim 6 in which said second axle stub has a cross-section with circular sections connected by a narrowed section; said circular sections of said second axle stub and said bearing surface of said second mounting being generally of equal radii; said narrowed section of said second axle stub having another radially projecting rib that is positioned inboard of said constricted section of said second mounting.

8. A water activity toy as defined in claim 7 in which said ribs have outer surfaces that cooperate with said bearing surfaces to rotatably support said paddle wheel when said axle stubs are positioned on said operational axis.

9. The water activity toy of claim 1, further comprising a crank attached to the second axle stub for rotating the paddle wheel.

10. A water activity toy comprising:

means defining a channel with opposed sides through which a stream of water may move;

first and second axle mountings on the opposite sides of the channel;

a rotatable paddle wheel, the wheel including at least one blade extending across the channel;

the paddle wheel including axially spaced apart first and second axle stubs that extend in opposite directions from the paddle wheel and define a rotational axis, the first and second axle stubs being respectively received in the first and second mountings on the opposite sides of the channel for rotation therein;

each of the first and second mountings including an axially extending bearing passage for receiving an axle stub for rotation therein, each of the mountings also having a side with a radial slot communicating into the respective bearing passage; a respective constriction at each mounting at each bearing passage, narrowing the respective radial slot sufficiently to inhibit the passage thereby of the respective axle stub;

the first axle stub having a projecting rib at a location axially therealong such that when the first axle stub is installed in the respective bearing passage, the rib on the axle stub prevents movement of the first axle stub out of the first bearing passage through the respective slot, and when the first axle stub is moved axially through the bearing passage sufficiently, the rib is no longer blocked by the constriction against radial movement of the first axle stub out of the bearing passage through the slot.

11. The water activity toy of claim 9, wherein each of the first and second axle stubs is respectively so shaped that at most rotation orientations of the wheel, the axle stubs are blocked by the respective constrictions on the mountings at the passage for preventing removal of the axle stubs from the bearing passages while at one rotation orientation of the wheel, the second axle stub is so shaped as to pass by the respective constriction to be moved out of the bearing passage past the constriction at the radial slot.

12. The water activity toy of claim 10, in which the second mounting includes an axially inwardly and downwardly sloping surface that faces the first mounting;

the paddle wheel including a formation that is moved downward along the sloping surface during installation of the paddle wheel in the mountings, such that cooperation between the formation and the sloping surface forces the first axle stub away from the sloping surface while moving the first axle stub axially through the bearing passage of the first mounting toward its outboard end.

13. The water activity toy of claim 10, in which the mountings are shaped such that during installation of the paddle on the mountings, the axle stubs are sloped with respect to said operational axis while the first axle stub moves axially along the bearing passage toward its outboard end, with the sloping between the axle stubs and the operational axis of rotation decreasing as the first axle stub approaches the outboard end of the bearing passage of the first mounting.

14. The water activity toy of claim 9, further comprising a crank attached to the second axle stub for rotating the paddle wheel.

* * * * *